US010703516B2

(12) United States Patent
Mainz et al.

(10) Patent No.: US 10,703,516 B2
(45) Date of Patent: Jul. 7, 2020

(54) METHOD FOR FILLING PACKS WITH VARYING PRODUCTS IN A FILLING MACHINE

(71) Applicant: SIG Technology AG, Neuhausen am Rheinfall (CH)

(72) Inventors: Hans-Willi Mainz, Heinsberg (DE); Sabine Knauff, Linnich (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 289 days.

(21) Appl. No.: 15/548,820

(22) PCT Filed: Dec. 4, 2015

(86) PCT No.: PCT/EP2015/078619

§ 371 (c)(1),
(2) Date: Dec. 13, 2017

(87) PCT Pub. No.: WO2016/124275

PCT Pub. Date: Aug. 11, 2016

(65) Prior Publication Data

US 2018/0186480 A1 Jul. 5, 2018

(30) Foreign Application Priority Data

Feb. 6, 2015 (DE) ..... 10 2015 101 751

(51) Int. Cl.
*B65B 3/00* (2006.01)
*B65B 3/02* (2006.01)
(Continued)

(52) U.S. Cl.
CPC ..... *B65B 3/025* (2013.01); *B65B 3/06* (2013.01); *B65B 25/22* (2013.01); *B65B 37/02* (2013.01);
(Continued)

(58) Field of Classification Search
CPC .... B65B 3/00; B65B 3/04; B65B 3/06; B65B 37/02; B65B 55/027; B65B 3/025; B31B 2150/00; B31B 2150/001
(Continued)

(56) References Cited

U.S. PATENT DOCUMENTS 4,590,734 A * 5/1986 Ueda ..... B65B 55/027 141/87
4,953,600 A * 9/1990 Tribert ..... B65B 3/04 141/1
(Continued)

FOREIGN PATENT DOCUMENTS

EP 2110359 A1 10/2009
WO 2008091143 A1 7/2008

*Primary Examiner* — Chelsea E Stinson
(74) *Attorney, Agent, or Firm* — The Webb Law Firm

(57) ABSTRACT

A method for filling packages with changing products in a filling machine is disclosed. Packages are successively transported through a filling machine, and the packages are each successively filled with a first product in a sterile environment via a filling outlet connected to a product tank. To empty the product tank, at least one outlet means is brought into an emptying position, and a residue of the first product is discharged at least partially from the sterile environment, via the outlet means located in the emptying position. The outlet means is removed from the emptying position following the emptying of the product tank. Packages are subsequently each successively filled with a second product in a sterile environment, via a filling outlet connected to a product tank.

20 Claims, 7 Drawing Sheets

(51) Int. Cl.

| | |
|---|---|
| ***B65B 37/02*** | (2006.01) |
| ***B65B 43/14*** | (2006.01) |
| ***B65B 43/26*** | (2006.01) |
| ***B65B 43/50*** | (2006.01) |
| ***B65B 55/02*** | (2006.01) |
| ***B65B 55/06*** | (2006.01) |
| ***B65B 55/10*** | (2006.01) |
| ***B65B 65/00*** | (2006.01) |
| ***B65B 3/06*** | (2006.01) |
| ***B65B 57/16*** | (2006.01) |
| ***B65B 57/14*** | (2006.01) |
| ***B65B 65/08*** | (2006.01) |
| ***B65B 43/52*** | (2006.01) |
| ***B65B 59/02*** | (2006.01) |
| ***B65B 51/14*** | (2006.01) |
| ***B65B 57/12*** | (2006.01) |
| ***B65B 25/22*** | (2006.01) |

(52) U.S. Cl.
CPC ..... *B65B 43/145* (2013.01); *B65B 43/265* (2013.01); *B65B 43/50* (2013.01); *B65B 43/52* (2013.01); *B65B 51/144* (2013.01); *B65B 55/027* (2013.01); *B65B 55/06* (2013.01); *B65B 55/10* (2013.01); *B65B 57/12* (2013.01); *B65B 57/145* (2013.01); *B65B 57/16* (2013.01); *B65B 59/02* (2013.01); *B65B 65/003* (2013.01); *B65B 65/08* (2013.01); *B65B 2210/08* (2013.01); *B65B 2220/02* (2013.01)

(58) Field of Classification Search
USPC ..... 53/426, 565, 458
See application file for complete search history.

(56) References Cited

U.S. PATENT DOCUMENTS

| | | | | |
|---|---|---|---|---|
| 5,027,585 | A * | 7/1991 | Russell | B65B 3/025 493/165 |
| 8,840,534 | B2 * | 9/2014 | Rapparini | B31B 50/32 493/163 |
| 2008/0083474 | A1 | 4/2008 | Mazzon | |
| 2010/0084044 | A1 | 4/2010 | Van Melick | |
| 2012/0085370 | A1 * | 4/2012 | Auer | B65B 55/10 134/23 |
| 2017/0341791 | A1 * | 11/2017 | Weiler | A61L 2/208 |

* cited by examiner

METHOD FOR FILLING PACKS WITH VARYING PRODUCTS IN A FILLING MACHINE

CROSS-REFERENCE TO RELATED APPLICATIONS

This application is the United States national phase of International Application No. PCT/EP2015/078619 filed Dec. 4, 2015, and claims priority to German Patent Application No. 10 2015 101 751.2 filed Feb. 6, 2015, the disclosures of which are hereby incorporated in their entirety by reference.

BACKGROUND OF THE INVENTION

Field of the Invention

The invention relates to a method for filling packages with changing products in a filling machine, wherein packages are successively transported through a filling machine and the packages are, in this regard, each successively filled in a sterile environment, in particular an aseptic area with a first product via a filling outlet connected to a product tank.

Description of Related Art

Methods for filling packages with products, in particular in the form of foodstuffs, are known in different designs. In this regard, the filling of the packages takes place with preferably flowable foodstuffs in a sterile or aseptic environment of a filling machine. Since the foodstuff should remain preserved for a long time after the filling of the packages, the most germ-free possible filling is desired. To this end, the filling machines comprise, for example sterilisation spaces or aseptic chambers, in which the packages are sterilised and subsequently filled and closed under the most sterile conditions possible.

As packages, in this regard, in particular packages which are open on the upper side are used in order to provide an opening for filling. The packages can be containers, for example cardboard composite packages, which are formed from a laminate comprising a cardboard layer and outer, in particular thermoplastic layers, for example made of polyethylene (PE). The cardboard confers sufficient stability on the packages, so that the packages can be easily handled and for example stacked. The plastic layers protect the cardboard from moisture and the foodstuff from the entry of undesired substances from the package. In addition, further layers can be provided, such as an aluminium layer, which prevents a diffusion of oxygen and other gases through the package.

The packages can be manufactured, preferably in the filling machine from a package precursor. Package material cutting can, for example be used as package precursor, which can be pre-assembled if required and form a package blank, for example by sealing longitudinal edges. Corresponding package blanks are typically applied on mandrels of a so-called mandrel wheel, wherein the cross-section of the mandrels corresponds to the cross-section of the package blank, which initially projects outwards over the mandrel. This projecting region of the package blank is folded against the front side of the mandrel and sealed there in order to form a package base or package head. Alternatively, the package material used for the package precursor can be unwound in a virtually infinite manner from a roll. In the case of a package cutting, said package cutting is folded on bend lines in order to initially form a package cover and a package base. By sealing overlapping sections of the package material, the package cover and the package base are closed. The head of the package initially remains open. If required, the package head can also initially be closed and the package can be filled through the open base, preferably directed upwards. Since this essentially makes no noteworthy difference for the method for filling packages, hereinafter the upper part of the package sealed and directed downwards in particular during the filling is viewed as the base of the package and the upper part of the package still unclosed in particular during the filling is viewed as the head of the package. It can essentially remain open as to whether the package is subsequently rotated for storage, transport and/or selling, or not, i.e. where top and bottom on the finished package is.

The packages are subsequently channelled into a sterilisation area of the filling machine. This takes place in most cases by the packages being transferred successively to the cells of the transport device receiving the packages. The transport device then ensures that the packages are transported with a defined speed at a defined distance to each other through the sterilisation area of the filling machine.

The packages are preheated in the sterilisation area, if required. To this end, the containers are blown with hot sterile air. Hydrogen peroxide is subsequently applied to the inner upper surfaces of the packages and at least the head region of the outer upper surface of the packages and they are sterilised in this regard. Drying of the sterilised packages with sterile air subsequently takes place. The sterilised packages are transferred into the filling and sealing area and are preferably filled with a foodstuff there. The foodstuff is, in this regard in particular flowable. In a number of cases, the foodstuff is beverages. The filled package is subsequently closed before the closed package is transported via the transport device from the filling and sealing area and is subsequently removed from the corresponding cells of the transport device.

A so-called aseptic area is formed in the filling and sealing area. The aseptic area designates the currently aseptic or sterile region in the upper section of the filling and sealing area. The aseptic chamber comprises the sterilisation area and the filling and sealing area. The aseptic chamber can be formed in the manner of a housing, wherein openings are provided for supplying and discharging packages. In addition, the aseptic chamber can comprise at least one opening at the lower end in order to remove the atmosphere from the sterilisation area and/or the filling and sealing area. The space below the aseptic chamber is not aseptic, which, however, does not affect the aseptic filling of the package.

In individual filling machines, the packages are transported from the transport device in a straight line through the filling machine. Corresponding filling machines are also designated as straight-running systems. In other filling devices, the so-called rotary systems, the packages detail a more or less arc-shaped movement, which can comprise one or a plurality of arc sections.

Irrespective of the type of filling machine, in most cases different products, for example foodstuffs are filled successively. Thus a first juice can initially be filled and subsequently a second juice can be filled on the same filling machine. In order to fill the packages, the filling machine comprises at least one filling outlet, which is connected to a product tank, in which the product to be filled is held. The product tank thus prepares a storage volume for the product to be filled. If the amount of the product in the product tank reaches a lower limit value, for example in an order between approximately 1 litre and 15 litres, the residual product can no longer be reproducibly filled. The predetermined filling amount of the packages can thus no longer be maintained precisely enough. For this reason, the packages to be filled with the residual amount must be channelled out and discarded. In this regard, however, a significant amount of waste develops. The number of packages to be disposed of is greater, the smaller the package sizes are. In addition, it takes a certain length of time until the residual emptying takes place and the corresponding packages are channelled out and the filling of the new product can be started. A product change is thus connected with an increased cost.

A further known approach consists of not using a package to empty the product tank into a cell of the transport device and holding this cell under the filling outlet in order to empty the residual amount of the product through the cell into a space below the aseptic chamber. The residual amount of the product can, in this regard, be received by a base trough below the transport device. In this way, wastage of packages can be saved and the emptying can be expedited. However, soiling of the transport device and/or the filling machine cannot then be reliably prevented by product injected back which is no longer sterile. This applies all the more when using filling outlets, which do not dispense the product perpendicularly downwards, but more or less laterally, as is the case for example with lateral jet outlets, which direct the product at an angle against the wall of the package blank in order to prevent a formation of foam. The corresponding angle can, for example be between 15° and 80°. Since cleaning of the transport device and the filling machine as well as a re-sterilisation is associated with a high degree of time expenditure and high personnel costs, the previously described approach is also associated with high costs.

SUMMARY OF THE INVENTION

An object of the invention is therefore to design and refine the method mentioned at the outset and previously described in detail such that a product change can take place in a more cost-effective manner.

This object is achieved by a method for filling packages with changing products in a filling machine, wherein packages are successively transported through a filling machine and the packages are, in this regard, each successively filled with a first product in a sterile environment, in particular an aseptic area via a filling outlet connected to a product tank, wherein in order to empty the product tank, at least one outlet means is brought into an emptying position and a residue of the first product is discharged at least partially from the sterile environment via the outlet means located in the emptying position, wherein the outlet means is removed from the emptying position after the emptying of the product tank and wherein packages are subsequently each successively filled with a second product in the sterile environment, in particular the aseptic area via a filling outlet connected to a product tank.

According to the invention, provision is made for the use of at least one outlet means, which is physically distinguished from the packages, however, can nevertheless be formed in a different manner. The outlet means can be provided at least partially, for example in the sense of pipe for conducting the product and/or in the sense of an open channel for draining the product. The outlet means can, however, also be designed at least partially only in the sense of a splash guard, for example when the product predominantly passes through the corresponding part of the outlet means in the form of an open jet. Depending on the requirements, the at least one outlet means can also comprise different sections of the type previously described.

In order for the outlet means not to hinder the filling of the packages before and after the product change, the outlet means can be brought into an emptying position and again removed from this position. In the emptying position, residue of the first product can be discharged from the sterile environment via the outlet means. In addition, the outlet means can in any case be moved from the emptying position so that the filling of further packages can take place without problems. If required, the outlet means can also be completely removed from the filling machine. In this case, however, it lends itself to firstly sterilise the outlet means before the outlet means is brought into the emptying position in order to not contaminate the sterile environment around the filling outlet. Alternatively, the outlet means can, however, also remain in the sterile environment around the filling outlet. Sterilisation of the outlet means can then generally be dispensed with.

After the emptying of the product tank and the removal of the outlet means from the emptying position, packages can again each be successively filled in a sterile environment via a filling outlet and in particular with a second product, i.e. a product, which is distinguished from the product filled prior to the emptying. Thus, for example mixing of the two products in a package can be at least largely avoided. The filling outlet can, in this regard, be connected to the same product tank as prior to the emptying or to a different product tank. It may be expedient to clean the product tank, the filling device and/or the filling outlet, for example to flush with a cleaning agent, such as water or with the second product in order to, as completely as possible, remove residues of the first product, if required. The emptying can then also comprise the discharge of cleaning agent used to flush and/or clean the product tank and/or the filling outlet, such as in the form of water and/or the second product, in addition to the discharge of the residues of the first product.

In the case of the first product and/or the second product, this is, in particular foodstuff, since sterile filling is important for foodstuffs to a particular extent. In this regard, they are also preferably flowable products, which can be filled in filling machines with at least one filling outlet into containers or packages. This applies in particular for liquid products. If required, the liquid products can, however, also comprise lumpy parts, such as fruit pulp or the like.

A product tank in the sense of the invention can preferably be a separate storage tank. This can, however, also be integrated into a filling device of the filling machine providing the filling outlet. The product tank, in this regard, does not have to accommodate the entire product to be filled. It is sufficient if the product tank can accommodate at least somewhat more than the residual amount of product, which is at least partially discharged from the sterile environment via the outlet means.

In this regard, the outlet means, alternatively or in additional, does not have to bridge the entire distance between the filling outlet and the edge of the sterile environment around the filling outlet. It is essentially sufficient, for example, if the outlet means is positioned at a certain distance under the filling outlet. The distance should, however, be so short that soiling of the transport device and/or the filling machine can be reliably avoided through the emptying of the product via the outlet means. In an analogous manner, the outlet means can also finish at a certain distance to the edge of the sterile environment around the filling outlet, if the draining of the product can, nevertheless, take place reliably without soiling the transport device and/or the filling machine. The outlet means serves for directing, in particular conducting the product to be emptied in a part of the sterile environment, in particular the aseptic area.

In the case of a first particularly preferred design of the method, the at least one outlet means is brought into an emptying position between two consecutive packages in order to empty the product tank. Packages can then also be present in the filling machine during the emptying, which shortens the required period of time between the last complete filling of a package with the first product and the first complete filling of a package with the second product, i.e. the period of time required for the emptying, if required. In any case, it can be avoided, if required, that the packages affect the emptying of the product tank. For the case that the packages in cells in a transport device are transported through the filling machine, the loading of the cells with packages can, in certain circumstances, be ruled out for at least one cell. The at least one unloaded cell can then be positioned under the filling outlet so that there is sufficient clearance in order to move the outlet means into the emptying position. Alternatively or in addition, it is, however, also possible to provide at least one cell with at least one outlet means instead of with a package, which can be inserted, for example into the at least one cell. The cells adjacent to the outlet means can, however, also be maintained laterally offset to the filling outlet and thus, if required, laterally offset to a filling position in order to provide room for the outlet means. Where appropriate, no package has to be discarded as waste from the packages located in the filling machine during emptying. Depending on the control of the filling machine, provision can also be made for some or all packages, which are located in the filling machine during emptying, to be discarded as waste.

In order to avoid a malfunction and to make an intervention of an operator as unnecessary as possible, when a predetermined process state is reached, which can, for example correspond to reaching a minimum fill amount of the product tank, the at least one outlet means can automatically be brought into an emptying position. A residue of the first product can then be discharged, if required, from the sterile environment, in particular from the aseptic area, at least partially via the outlet means located in the emptying position, which can also take place automatically for the sake of simplicity. Alternatively or in addition, the outlet means is removed from the emptying position automatically after the emptying of the product tank. The end of the emptying can then, for example be defined by a predetermined process state in order to avoid a malfunction.

It is otherwise particularly preferred if an outlet means, in particular in the form of a package mock-up, with at least one base opening, without a base and/or at least one lateral opening is used. The outlet means can then, for example be transported and/or sterilised through the filling machine like the packages to be filled. The entry of germs into the sterile environment around the at least one filling outlet can thus be avoided or separate handling of the outlet means may be unnecessary, by way of which the outlet means is brought into the emptying position. In addition, the outlet means can be manufactured from a package material simply and cost-effectively, from which the packages are, for example also manufactured. The outlet means then do not have to be cleaned in a time-consuming manner. The outlet means can instead be simply disposed of. It is also preferred, if the outlet means, in particular in the form of package mock-ups, are manufactured in an analogous manner to the packages from a package precursor or package blank, for example with the difference that parts of the package material are removed, in particular punched out in order to form the described opening.

In this context, it has proven particularly expedient if at least one outlet means, in particular in the form of a package mock-up, with a base opening is used, the cross-sectional area of which only corresponds to a part, preferably less than 50%, in particular less than 30%, of the cross-sectional area and/or the base area of the package and/or outlet means. In this case, the emptied product can easily and generously flow out from the outlet means at the lower end. However, at the same time, it is avoided that product, which once it has left and is no longer sterile, gets back into the outlet means and/or into the sterile environment around the filling outlet.

Alternatively or in addition, a package mock-up can be used as at least one outlet means with outer dimensions, which correspond at least substantially to the outer dimensions of the packages to be filled with the first product and/or with the second product. The packages to be filled with the first and/or the second product are namely adapted to the outlet behaviour of the filling outlet such that the corresponding product is not sprayed or only negligibly sprayed out of the latter when filling the package. In order to ensure this also when using the outlet means, substantially the same dimensions can be referred back to for the outlet means for the sake of simplicity.

If the packages are formed from package cuttings, package precursors and/or package blanks held in storage in a bundle, wherein the bundle can, for example be a stack of a number of package cuttings, package precursors and/or package blanks adjacent to or stacked on top of each other, for the sake of simplicity prior to the emptying of the product tank, at least one package cutting, package precursor and/or package blank for forming the at least one outlet means is introduced into the bundle. It is, in this regard, particularly simple to position the package cutting, package precursor and/or the package blank for forming the at least one outlet means at the end of the bundle. The package cutting, the package precursor and/or the package blank for forming the at least one outlet means is then subsequently removed from the bundle in order to then be shaped into the outlet means and, if required, be transferred to the filling machine. This is not mandatory, however, the package cutting, the package precursor and/or the package blank for forming the at least one outlet means is preferably introduced into the bundle of package cuttings at a predetermined point. A separate detection of the outlet means to control the method can then be dispensed with, if required. It can thus however, alternatively or in addition, also be ensured that the outlet means arrives into the emptying position after a predetermined number of packages, wherein the residual amount of product, from which the emptying process is initiated, can be matched, if required, to this number of packages or to the amount of product to be filled in these packages.

In order to further automate, simplify and/or prevent errors, the introduction of a package cutting, package precursor and/or package blank for forming the outlet means, in particular in the form of a package mock-up can take place automatically when a predetermined process state is reached. It is particularly simple and reliable for the method if the predetermined process state is a minimum fill amount of the product tank. Other process states are, however, also conceivable. A process change can, however, also take place, if required, without a minimum fill amount being reached in the product tank.

If the packages to be filled are transferred to cells of a transport device, such as at a transfer position, and are then transported via the transport device in the cells through a filling machine, it lends itself to also transport the at least one outlet means, whether it is an outlet means in the form of a package mock-up or another outlet means, via the transport device in at least one cell through the filling machine for the sake of simplicity. In order to further simplify the method, it is possible to transfer the outlet means to a cell of the transport device at the transfer position, at which the packages are also transferred to the cells of the transport device.

Different transport devices are, very generally, possible for transporting the packages and, if required, also the at least one outlet means through the filling machine. So-called cell chains are, in this regard, simple and reliable, which are circulating continuous chains, which are connected with cells and can be driven in a known manner. The cell chain is, for example arranged below the cells provided with packages. This is, in particular the case when the packages are transported in a substantially straight line through the filling machine in the form of a straight-running system. It can, however, also be provided laterally to the cells provided with packages. This is, in particular, the case in so-called rotary systems, in which the packages are guided at least partially in an arc and, in particular, along rotating processing stations, in which the packages are heated, sterilised, dried, filled and/or closed. Each of these processing steps can, in this regard, be carried out at a separate rotating processing station or together with further processing steps at a common processing station. However, the precise design of the filling machine is of less concern in the context of the present invention, which is why the different types of filling machines, which are known from the prior art, are also only described very generally here.

A simple and reliable procedure can, alternatively or in addition, be achieved in that the at least one outlet means with at least one cell, i.e. via the transport device, is positioned in a filling position under the filling outlet. Since the packages also have to be positioned for filling very precisely under the filling outlet in the filling position, the transport device matched accordingly can also be used for the transport of the outlet means into the emptying position, in particular under the filling outlet. Since an amount of product has to be drained, where appropriate, when emptying the product, which is greater than the fill amount of a package, it may be expedient to stop the outlet means in the filling position during the emptying of the product tank via the transport means. The outlet means can thus be held in the emptying position for longer than the packages are held in the filling position. The emptying position of the outlet means can also correspond to the filling position of the packages. There is thus, on the one hand, more time available and the risk of undesired impurities is reduced. If required, the packages are also stopped for filling briefly under the filling outlet. The period of time, for which the outlet means is held in the emptying position, can be measured as greater than the period of time, for which the packages are each held in the filling position. Otherwise in the case that the at least one outlet means is moved in at least one cell to the emptying position, the emptying position and the filling position correspond to each other. This simplifies, for example the control of the filling machine or the method.

It is essentially simple and cost-effective if the at least one outlet means, in particular in the form of a package mock-up, is manufactured from a package material, in particular package material laminate. In this regard, for the sake of the further simplicity of the method, the same package material is preferably used as is used to form the packages. The outlet means and/or the package are then preferably manufactured by folding and sealing. The outlet means and/or the package can also be transferred to at least one cell of a transport device and moved in the cell through the filling machine in any case substantially up to the emptying position. The package material laminate for forming the outlet means and/or the package can comprise a cardboard layer, a barrier layer, for example made of aluminium, outer seal layers made of a thermoplastic such as polyethylene (PE) and/or further layers. Package materials of this type are sufficiently known from the prior art and thus do not require further explanation here. The outlet means can, however, also be manufactured from another material, for example a plastic, wherein the outlet means is then preferably rather rigid in order to avoid an undesired collapsing of the outlet means.

In order to avoid soiling of the filling machine when a product is emptied, the outlet means used therefor can, for example be designed at least partially in a cover and/or sleeve shape.

In addition, the outlet means can be reused and can be brought from a preferably upper or lateral rest position within the sterile environment into the preferably lower emptying position. The outlet means then does not have to firstly be channelled into the filling machine and after emptying channelled out of the filling machine again. After the emptying, the outlet means can consequently, if required, be moved from the emptying position back into the rest position again. Since the rest position and preferably also the emptying position are located in the sterile environment of the filling outlet, sterilisation of the outlet means prior to and/or after the emptying is unnecessary. It can still lend itself to clean and/or sterilise the outlet means now and then in order to avoid contamination of the sterile environment. In order that the outlet means does not have to be cleaned so often, it lends itself if the product is directed substantially in the form of an open jet through the outlet means and the outlet means primarily serves as a splash guard in order to prevent soiling of the filling machine.

Alternatively or in addition, at least one outlet means can, however, also initially be sterilised and subsequently brought into the emptying position preferably laterally to the transport direction of the packages. In this regard, the supply of the outlet means can take place without germs entering into the sterile environment around the filling outlet. After the emptying, the outlet means can, if required, again be removed from the filling machine in the same manner. Depending on the type of the outlet means, it may be cost-effective to discard the outlet means and to use a new outlet means for the subsequent emptying or to clean and reuse the outlet means.

It has emerged as generally preferred to discharge the residue of the first product from the sterile environment, in particular the aseptic area, via the at least one outlet means downward and/or to the side. In this regard, the force of gravity can be utilised, for example. In addition, the space for discharging the product, present laterally and/or below, can be used. In this regard, a base trough of the filling machine provided in any case, where appropriate, can, alternatively or in addition, be used in a simple manner to collect the product drained via the outlet means during emptying.

If required, the residue of the first product to be emptied can also be collected via the at least one outlet means and be discharged with the at least one outlet means from the sterile environment, in particular the aseptic area. No additional collection system is then required, which also cannot be consequently soiled by the emptying. This simplifies, where appropriate, the constructive expense for the filling machine. If the outlet means is removed from the sterile environment or the filling machine and disposed of outside the sterile environment or the filling machine, this can take place simply and quickly without an entry of germs into the sterile environment having to be feared.

It is quite essentially preferred if the method is used for a filling machine, in which the inner space of the packages is sterilised during the transport of the packages successively through the filling machine, the packages are filled with the first or the second product and the packages filled with the first or second product are closed. If required, heating of the packages can be provided prior to sterilisation and/or drying of the packages can be provided after sterilisation. For filling machines of this type, the emptying namely presents a particular problem such that the advantages according to the invention particularly come into effect for such filling machines. If required, the outlet means can also be passed through the previously described method steps or processing stations at least partially instead of a package. The process parameters and method parameters can then, compared with the filling of packages, also be maintained at least substantially for the emptying. It can, in particular be provided that the opening cross-section of the reducing valve in the filling section and/or the type of the filling outlet, the filling parameters and/or the sterilisation parameters are maintained.

BRIEF DESCRIPTION OF THE DRAWINGS

The invention is explained in greater detail below by means of a drawing merely depicting exemplary embodiments. In the drawing, is shown FIG. 1 a first device for carrying out a first method according to the invention in a schematic depiction, FIG. 2 a detail of a second device for carrying out a second method according to the invention in a schematic depiction, FIG. 3 a detail of a third device for carrying out a third method according to the invention in a schematic depiction, FIG. 4 a detail of a fourth device for carrying out a fourth method according to the invention in a schematic depiction, FIG. 5 a package blank for forming a package for carrying out the first method according to the invention in a perspective view and FIG. 6 a package blank for forming an outlet means for carrying out the first method according to the invention in a perspective view and FIG. 7 an outlet means for carrying out the first method according to the invention in a perspective view.

DESCRIPTION OF THE INVENTION

Figure 1:
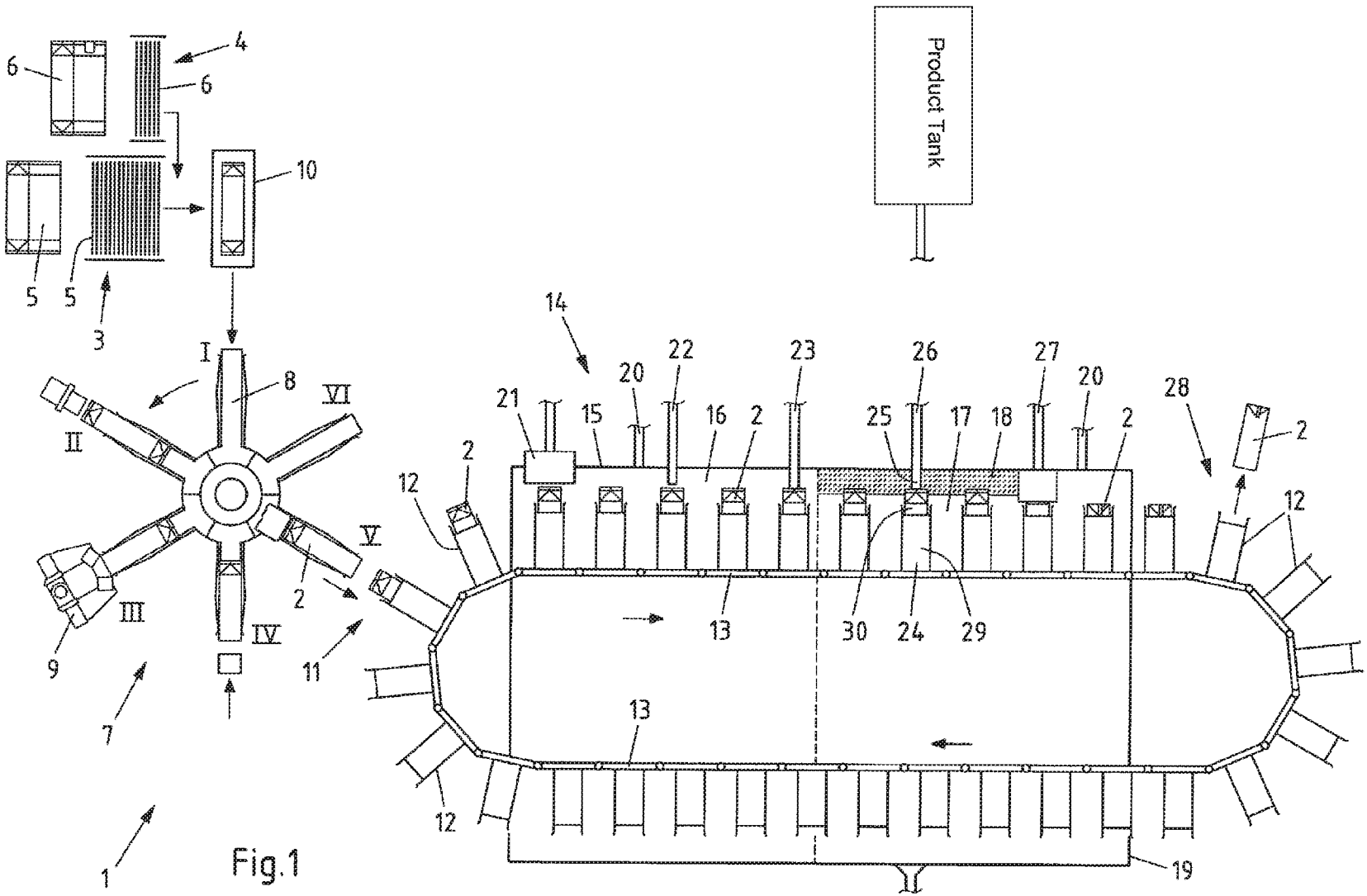

A device 1 for shaping, filling and closing packages 2 is depicted in FIG. 1. The packages 2 are in particular cardboard packages made of corresponding package material laminates with at least one cardboard layer, at least one barrier layer, for example consisting of aluminium, polyamide and/or an ethylene vinyl alcohol and outer layers made of a thermoplastic, in particular polyethylene (PE). The device 1 depicted and preferred in this respect comprises two bundles 3, 4 of package blanks 5, 6 in the form of package material cuttings, the longitudinal edges of which are sealed to each other and thus form package covers, which are held folded together adjacent in the bundles 3, 4. The package blanks 5, 6 are unfolded by a feeding device 10. In the case of the device depicted and preferred in this respect, an application device can also be provided, such as in the form of an injection moulding machine, for applying, in particular injecting pouring elements, not depicted, onto the package blank 5, 6.

The mandrel wheel 7 depicted and preferred in this respect comprises six mandrels 8 and rotates cyclically, i.e. gradually, anticlockwise. A package blank 5, 6 is pushed on the mandrel 8 in the first mandrel position. Spring clamps, not described in greater detail, in this regard, secure the position of the package blank 5, 6 on the mandrel 8. Subsequently, the mandrel wheel 7 is rotated further into the subsequent mandrel wheel position II, in which the base region of the package blank 5, 6 is heated via a hot air fan, not described in greater detail, with hot air. The heated base region is prefolded by a press 9 in the subsequent mandrel wheel position III and is sealed into a base in the following mandrel wheel position IV in the folded position by a sealing device, not described in greater detail. A package 2 closed on one side is thereby obtained, which is removed from the mandrel in the following mandrel wheel position V and transferred into a transfer position 11 to a cell 12 of a continuous transport device guided in a circle. The package 2 is, in this regard, partially received in the cell 12 and is preferably held there in a positive-locking manner. The transport device 13 depicted and preferred in this respect is a so-called cell chain. No work step is assigned in the subsequent mandrel wheel position VI. The number of mandrel wheel positions or mandrels 8 and the processing steps provided there can, if required, deviate from the depiction according to FIG. 1 and the associated description.

The package 2 with the open head region directed upwards is transported from the transfer position 11 with the aid of the transport device 13 in the associated cell 12 through a filling machine 14. If required, the package 2 could also be filled through the base region directed upwards if the head region directed downwards were closed. The filling machine 14 comprises an aseptic chamber 15, which comprises a sterilisation area 16 and a filling and sealing area 17, through which a row of packages 2 is successively transported. The transport direction 13 of the packages 2, in this regard, points from left to right as is symbolised by the arrows, wherein the transport of the packages 2 does not have to take place in a straight line, but can also take place in at least an arc or even in a circle. The transport device 13 is not completely sterile such that the aseptic region, in particular the aseptic area 18, of the filling and sealing area 17 ends in any case at the transport device 13 below the cells 12. However, the region within the packages 2 and above the packages 2 in the filling and sealing area 17 is at least sterile. This minimal region is indicated by the shaded aseptic area 18 and should also be maintained sterile for a product change. At the lower end of the filling and sealing area 17 and below the transport device 13, there is a collection trough 19, from which the collected liquid can be drained, for example via a base outlet.

In order to avoid contamination of the sterile environment, of the aseptic area 18, a current of sterile air is preferably maintained from above to below in the aseptic chamber 15. To this end, corresponding sterile air connections 20 are provided along the aseptic chamber 15 to supply sterile air.

The sterilisation area 16 and the filling and sealing area 17 are separated by a curtain of sterile air in the depicted device 1, which is blown in from above and flows downwards in a substantially laminar manner. Alternatively or in addition to the curtain, a sluice or a confined space would also be conceivable, which just allows the containers or packages 2 through into the filling and sealing area 17, however, which holds back the atmosphere from the sterilisation area 16 at least tendentially.

Following the entry into the sterilisation area 16, the packages are successively preheated by a preheating device 21 by being blown with hot sterile air. Subsequently, a mixture of steam, hydrogen peroxide and preferably filtered air is applied to the packages 2 by means of a sterilisation device 22 in order to, in any case, sterilise the inner sides of the packages 2. After this, the packages 2 are dried by applying sterile air via a drying device 23 and brought into a filling position 24 below a filling outlet 25 of a filling device 26 after the transfer from the sterilisation area 16 to the filling and sealing area 17. The packages 2 are successively filled there, in particular with a foodstuff. The filled packages 2 are then closed with a closing device 27 by folding the upper region of the package 2 and sealing. The closed packages 2 are subsequently transported by means of the transport device 13 from the aseptic chamber 15 and the filling machine 14. The packages 2 are removed from the cells 12 of the transport device 13 in a removal position 28. The now empty cells 12 are moved further in the direction of the transfer position 11 with the transport device 13 in order to receive further packages 2 there.

The previously described device 1 is operated in the likewise previously described manner until a product change is imminent. The filling machine 14 depicted and preferred in this respect detects when the amount of product held in a product tank, not depicted in greater detail, for filling falls below a predetermined minimum amount and/or when a product change is required. Such a blank 6 is then removed from a bundle 4 of blanks 6 for outlet means and inserted into the bundle 3 of package blanks 5 and preferably at the end of the bundle 3 of package blanks 5. The blank 6 for the outlet means is manufactured from the same package material as the usual packages 2 and also from a package material cutting, which is sealed at the overlapping longitudinal edges to form a blank 6. Unlike the usual packages 2, the blank 6 of the outlet means comprises at least one recess in the base region.

The blank 6 of the outlet means is gripped by the feeding device 10, unfolded and pushed onto the mandrel wheel 7. Subsequently, as has been already previously described for the packages 2, a base is formed. As a result of the recess of the base region of the blank 6 of the outlet means, the base of the thus formed outlet means 30 is not completely closed. In fact, at least one opening remains. If the corresponding outlet means 30 arrives at the filling position 24 of the packages 2 below the filling outlet 25 and thus into the emptying position 29 of the outlet means 30, the residue of the product in the product tank is introduced into the outlet means 30, at least substantially via the filling outlet 25, from said outlet means 30 the product then leaves via the opening at the base and is directed into the collection trough 19 below the transport device 13. If the product tank is emptied, the filling outlet 25 can be connected to a product tank of a second product or the product tank can be filled with a second product. If required, the filling device 26 can also, alternatively or in addition, be rinsed with a rinsing medium or with the second product after the emptying so that at least substantially pure second product can subsequently be filled.

Since the inner sides of the outlet means 30 have been sterilised and the cross-section of the opening is not too large, the outlet means 30 prevents contamination of the environment through splashing product such as from the collection trough 19. The outlet means 30 also ensures via the opening that the product is dispensed in a controlled manner. After the emptying, the head region of the outlet means 30 can be closed before the outlet means 30 leaves the filling machine 14 and is removed in the removal position 28 from the corresponding cell 12 of the transport device 13. The outlet means is subsequently preferably disposed of. After the emptying, as has been previously described, further package blanks 5 are also formed into packages 2, which are transported into the filling position 24 and filled there.

In the case of an alternative design of the method not depicted, an outlet means, which, if required, is not foldable, can be used for emptying. This is then inserted into a cell of the transport device 13 prior to emptying, for example when a determined amount of residual product in the transfer position 11 is reached, instead of a package 2 taken off the mandrel wheel 7. The outlet means then in turn passes through the filling machine 14, as the usual packages 2. If the outlet means arrives in the filling position 24 of the package 2 and thus in the emptying position 29 of the outlet means, the product to be emptied is emptied through the outlet means as previously described. Subsequently, however, closing of the outlet means in the head region preferably does not take place, either because the closing device 27 for closing the head region of the packages 2 is briefly deactivated at the correct time and/or not activated or because the outlet means is designed and/or is received in the corresponding cell such that the outlet means projects less further upwards from the cell 12 in contrary to the usual packages 2 and is thus not gripped by the closing device 27.

Figure 2:
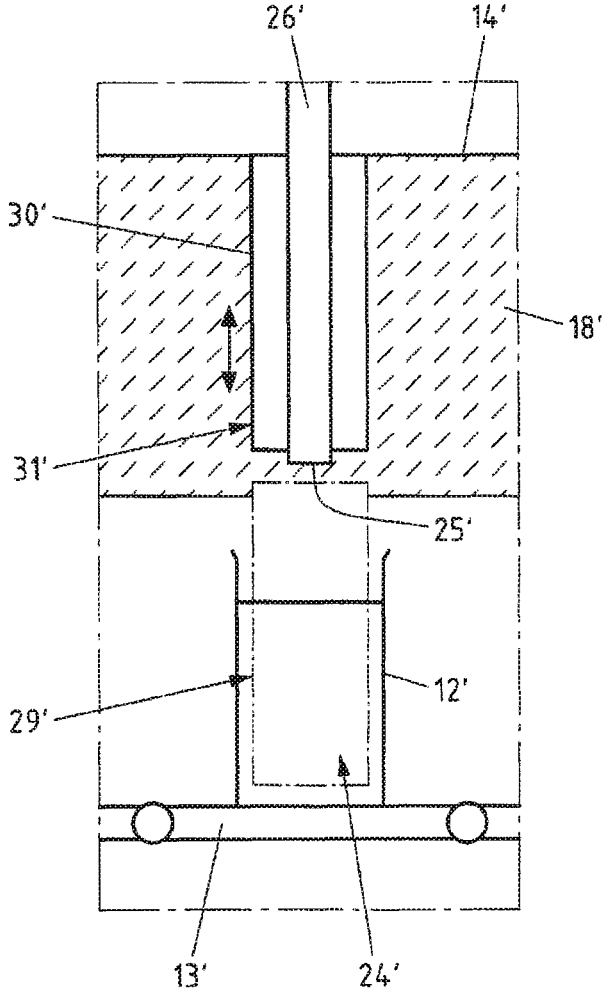

A further alternative method for carrying out the product change of a filling machine 14' is depicted in FIG. 2. This is based on the fact that the outlet means 30' adopts a rest position 31' in the sterile region, i.e. the aseptic area 18', of the filling machine 14'. In this position, the filling of a product via the filling outlet 25' of the filling device 26' is not hindered. In order to empty, the outlet means 30' can then be moved from this rest position 31' into a lower-lying emptying position 29'. This emptying position 29' is depicted in FIG. 2 by a dotted line. Furthermore, provision is made for the depicted alternative method that the outlet means 30' is immersed into the cell 12' located in the filling position 24' in order to arrive into the emptying position 29' and preferably substantially up to the contact area for the packages. The outlet means 30' is preferably designed in a sleeve shape. In this regard, the outlet means 29' can comprise a round or square cross-section corresponding to the cross-section of the cell 12', if required. Alternatively or in addition, the lower region of the outlet means 30' can be partially closed in order to obtain a controlled outlet of product. When the outlet means 30' has reached the lower emptying position 29', the emptying takes places via the filling outlet 25' as in principle previously described. If the emptying has concluded, the outlet means 30' can be moved again upwards into the rest position 31'. The transport device 13' subsequently rotates further and then packages are filled with the second product, as has been already previously explained.

Figure 3:
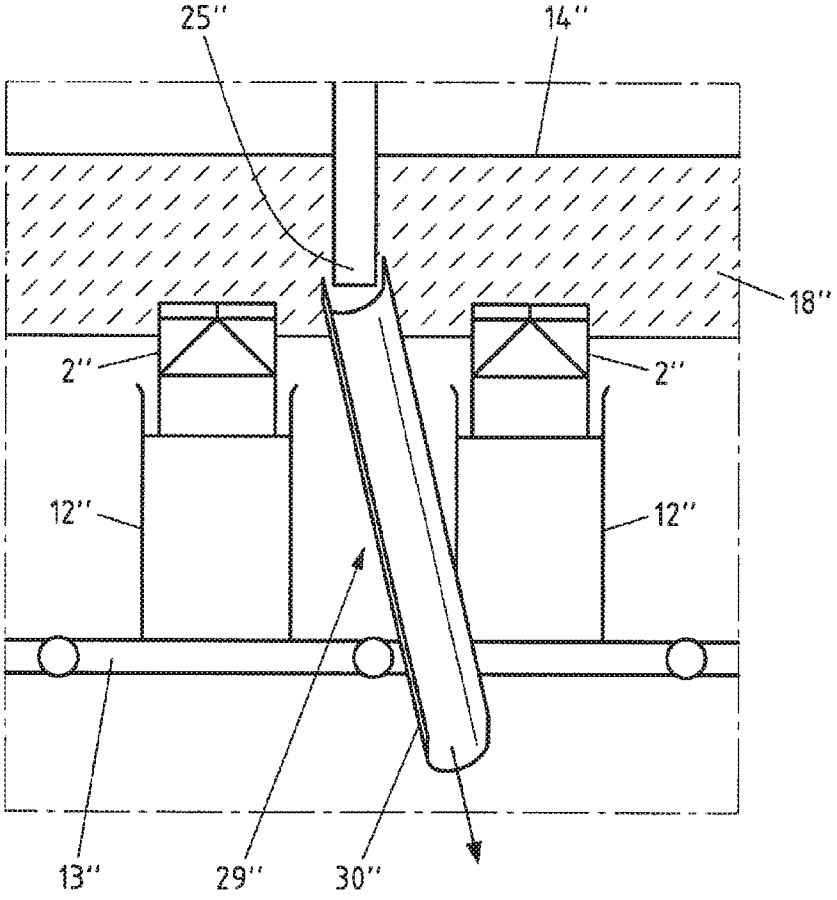

In the case of a further alternative method depicted in FIG. 3, an outlet means 30" in the form of a receptacle is brought laterally into the emptying position 29" below the filling outlet 25" of a filling machine 14" and partially into the aseptic area 18". The product to be emptied and, if required, the medium used for rinsing, where appropriate, can then be collected from the outlet means 30". Subsequently, the outlet means 30" is again laterally removed from the emptying position 29" and can be emptied and/or discarded. If required, the transport device 13" can be stopped prior to introducing the outlet means 30" into the emptying position 29" in a position, in which no cell 12" and no package 2" is positioned directly under the filling outlet 25", i.e. for example not in the filling position 24" in order to provide space for a simple lateral introduction of the outlet means 30".

Figure 4:
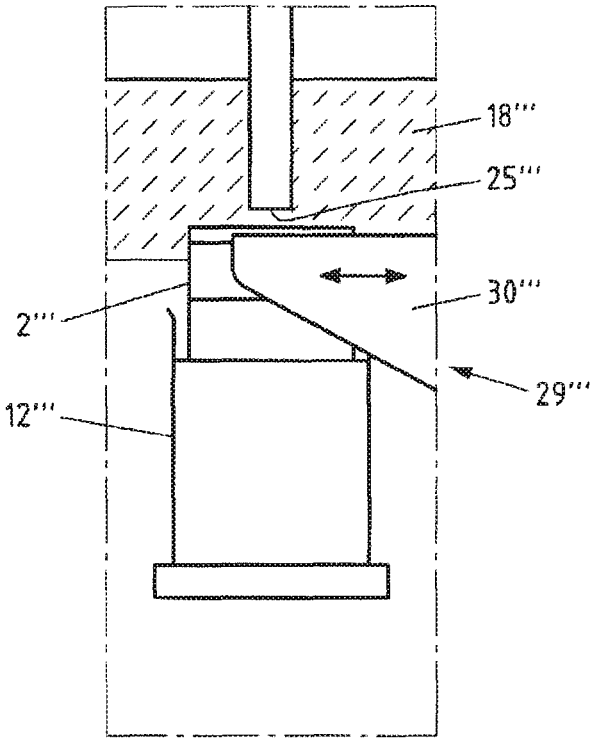

A further alternative method for carrying out a product change is depicted in FIG. 4. Only an outlet means 30'" in the form of a channel, if required, a pipe, a funnel or the like would also be conceivable, is pushed into the emptying position 29'" under the filling outlet 25'" when the product tank has to be emptied for the purpose of the product change. The outlet means 30'" can be positioned between two packages 2'" held in cells 12'" and partially in the aseptic area 18'". The product then emptying out of the filling outlet 25'" can be guided slightly to the side and collected there and/or discarded. To this end, it lends itself if the outlet means 30'" is inclined downwards to the side in order to utilise the force of gravity.

Figure 5:
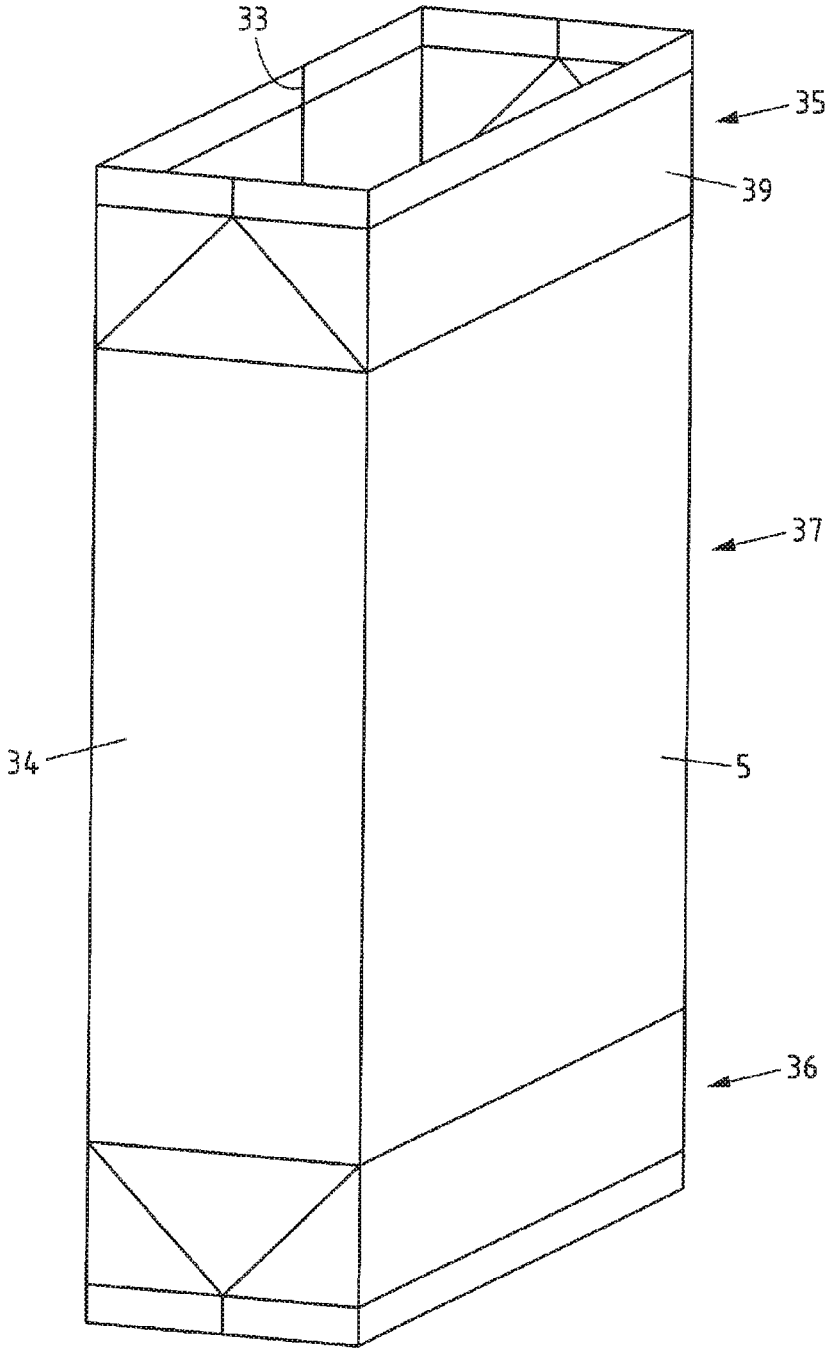

A package blank 5 from a package material cutting 34 sealed along overlapping longitudinal edges 33 is depicted in FIG. 5. The head region 35 and the base region 36 at the opposing longitudinal ends of the package blank 5, which are distanced from a, for example rectangular or square cover region 37 of the package 2, are still unclosed. The head region 35 and the base region 36 are closed by folding and subsequent sealing, wherein the base 38 is formed prior to filling and the head 39 of the package 2 is formed after filling. This could also alternatively take place in reverse sequence. Furthermore, the head region 35 can, if required, still be provided with a pouring element. In addition, the head region 35 can be folded flat or folded around in a gable shape.

The base region 36 is preferably folded flat, which is sufficiently known from the prior art.

Figure 6:
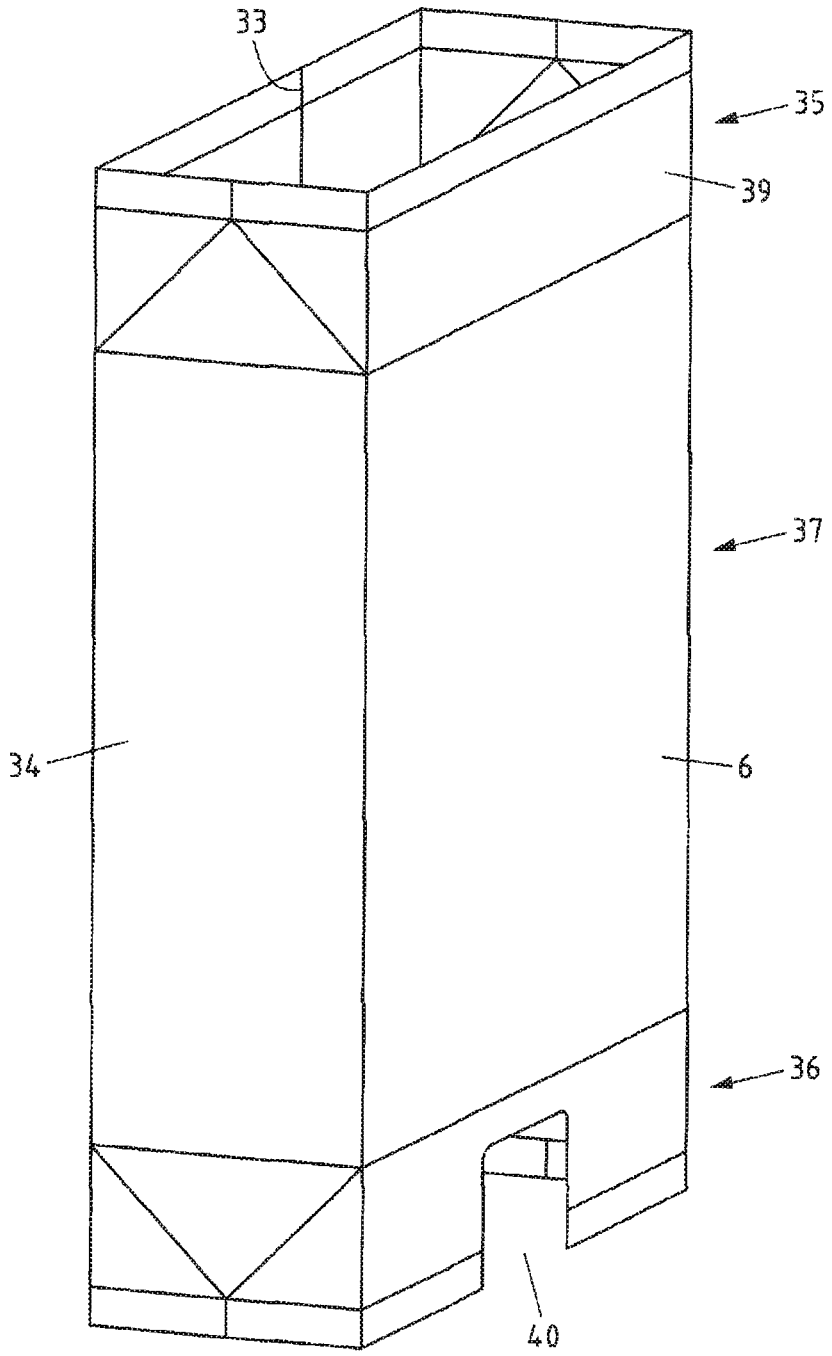

As it is depicted in FIG. 6, in order to form an outlet means 30 from a package material laminate, in the form of a package material cutting 34, at least one recess 40 can be provided, in particular punched out, in the base region 36 of a package blank 6 from the package cutting 34, unlike in the package blanks 5 provided for filling in a known manner and depicted in FIG. 5. The package material laminate of the packages 2 and the outlet means 30 can, in this regard, be constructed in the same manner.

Figure 7:
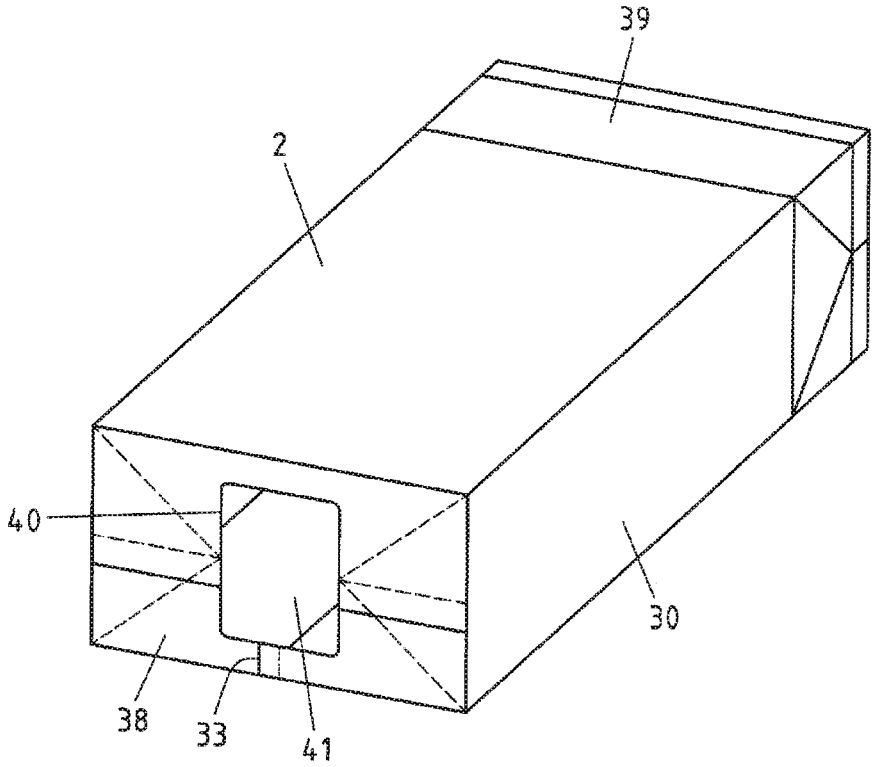

After closing the correspondingly pretreated base region 36, the base 38 consequently comprises at least one opening 41, as is also depicted only by way of example in FIG. 7. Alternatively, an outlet means can be manufactured from a different material to a package material laminate. In this regard, it can be, for example a plastic, which can be converted into the form of the outlet means, for example in the course of the injection moulding. The outlet means then comprises, if required, a similar form to the outlet means formed from a package material laminate depicted in FIG. 7, wherein a base could also be entirely dispensed with.

LIST OF REFERENCE NUMERALS

1 Device
2 Package
3,4 Bundle
5,6 Package blanks
7 Mandrel wheel
8 Mandrel
9 Press
10 Feeding device
11 Transfer position
12 Cell
13 Transport device
14 Filling machine
15 Aseptic chamber
16 Sterilisation area
17 Filling and sealing area
18 Aseptic area
19 Collection trough
20 Sterile air connections
21 Preheating device
22 Sterilising device
23 Drying device
24 Filling position
25 Filling outlet
26 Filling device
27 Closing device
28 Removal position
29 Emptying position
30 Outlet means
31 Rest position
33 Longitudinal edges
34 Package material cutting
35 Head region
36 Base region
37 Cover region
38 Base
39 Head
40 Recess
41 Opening

The invention claimed is:

1. A method for filling packages with changing products in a filling machine comprising:

successively transporting packages through a filling machine such that the packages are, in each case, successively filled with a first product in a sterile environment via a filling outlet connected to a product tank, transferring the packages to be filled to cells of a transporting device, wherein the packages to be filled are transported via the transporting device cells through a filling machine, in which at least one outlet means in the form of a package mock-up with at least one base opening, without a base, and/or at least one side opening is used, in which the at least one outlet means is transferred to a cell of the transporting device cells and is transported via the transporting device, while in the cell, through the filling machine, in order to empty the product tank bringing the at least one outlet means into an emptying position and discharging a residue of the first product at least partially from the sterile environment via the outlet means located in the emptying position, wherein the outlet means is removed from the emptying position after the emptying of the product tank, and successively filling the packages, in each case, with a second product in a sterile environment via the filling outlet connected to said product tank or a second product tank or a second filling outlet connected to the second product tank.

2. The method according to claim 1, wherein in order to empty the product tank the at least one outlet means is brought into an emptying position between two consecutive packages.

3. The method according to claim 1, further comprising:

when a predetermined process state is reached, automatically bringing the at least one outlet means into an emptying position and discharging a residue of the first product at least partially from the sterile environment via the outlet means located in the emptying position and/or automatically removing the outlet means from the emptying position after the emptying of the product tank.

4. The method according to claim 3, wherein the predetermined process state comprises a minimum fill amount of the product tank.

5. The method according to claim 1, wherein an outlet means with a base opening is used, the cross-sectional area of which corresponds to only a part of the cross-sectional area and/or the base area of the package and/or outlet means.

6. The method according to claim 5, wherein an outlet means is used having external dimensions that correspond at least substantially to the external dimensions of the packages to be filled with the first product and/or with the second product.

7. The method according to claim 5, wherein the packages are formed from package cuttings, package precursors and/or package blanks held ready in a bundle, and wherein prior to the emptying of the product tank a package cutting, a package precursor and/or a package blank is introduced at a predetermined point into the bundle of package cuttings, package precursors and/or package blanks for forming the least one outlet means.

8. The method according to claim 7, wherein the introduction of a package cutting, package precursor and/or package blank for forming the outlet means takes place automatically when a predetermined process state is reached.

9. The method according to claim 8, wherein the predetermined process state comprises a minimum fill amount of the product tank.

10. The method according to claim 5, wherein the cross-sectional area of the base opening corresponds to less than 50% of the cross-sectional area and/or the base area of the package and/or outlet means.

11. The method according to claim 1, comprising:

transferring the packages to be filled to a transfer position and, then, to the cells of a transporting device, wherein the packages to be filled are transported via the transporting device cells through a filling machine, and wherein the at least one outlet means is transferred to a cell of the transporting device at the transfer position and is transported via the transporting device in the cell through the filling machine.

12. The method according to claim 1, wherein the at least one outlet means is positioned with the cell in a filling position underneath the filling outlet, wherein the packages are filled in the filling position via the filling outlet, and wherein the outlet means is held in the filling position via the transporting device during the emptying of the product tank.

13. The method according to claim 1, wherein the least one outlet means is formed either from a packaging material laminate or from a plastic.

14. The method according to claim 13, wherein the at least one outlet means is formed from the packaging material laminate by folding and sealing.

15. The method according to claim 14, wherein the folded and sealed outlet means is transferred to a cell of the transporting device and is transported to the cell through the filling machine.

16. The method according to claim 1, comprising:

sterilising the at least one outlet means and bringing the at least one outlet means into the emptying position.

17. The method according to claim 16, wherein the at least one outlet means is brought into the emptying position laterally to the transporting direction of the packages.

18. The method according to claim 1, comprising:

discharging the residue of the first product via the at least one outlet means downwards and/or to the side from the sterile environment.

19. The method according to claim 1, comprising:

during the transport of the packages through the filling machine, successively sterilising the interior of the packages, filling the packages with the first or the second product, and closing the packages filled with the first or second product.

20. The method according to claim 1, wherein the sterile environment comprises an aseptic area.

* * * * *